United States Patent [19]

Yamazaki et al.

[11] 4,075,836

[45] Feb. 28, 1978

[54] EXHAUST MANIFOLD FOR INTERNAL COMBUSTION ENGINE

[75] Inventors: Shuichi Yamazaki, Kamifukuoka; Ikuo Kajitani, Niiza; Michio Kawamoto, Tokyo, all of Japan

[73] Assignee: Honda Giken Kogyo Kabushiki Kaisha, Tokyo, Japan

[21] Appl. No.: 677,668

[22] Filed: Apr. 16, 1976

[30] Foreign Application Priority Data

| | | |
|---|---|---|
| Apr. 22, 1975 | Japan | 50-54081[U] |
| May 28, 1975 | Japan | 50-70993[U] |
| May 28, 1975 | Japan | 50-70994[U] |
| May 28, 1975 | Japan | 50-70995[U] |

[51] Int. Cl.[2] ..... F01N 3/10

[52] U.S. Cl. ..... 60/282; 60/322

[58] Field of Search ..... 60/282, 323, 322

[56] References Cited

U.S. PATENT DOCUMENTS

| | | | |
|---|---|---|---|
| 3,413,803 | 12/1968 | Rosenlund | 60/282 |
| 3,486,326 | 12/1969 | Hermes | 60/322 |
| 3,633,368 | 1/1972 | Rosenlund | 60/323 |
| 3,722,221 | 3/1973 | Chopin | 60/323 |
| 3,957,446 | 5/1976 | Mayer | 60/282 |

*Primary Examiner*—Douglas Hart
*Attorney, Agent, or Firm*—Lyon & Lyon

[57] ABSTRACT

An exhaust manifold for a multi-cylinder engine employs three concentric exhaust reaction chambers. Exhaust inlet pipes convey hot exhaust gases from the exhaust ports of the engine directly into the innermost reaction chamber. The concentric reaction chambers extend substantially at right angles to the exhaust inlet pipes which are parallel. Concentric tubes encircle the exhaust inlet pipes and each is connected to one of the concentric exhaust chambers. The flared portions of the exhaust inlet pipes engage in surface contact with the correspondingly flared portions of the tubes. End members having concentric shoulders engage cylindrical shells which define the exhaust reaction chambers. Bolted spacers are positioned substantially midway of the length of the shells and space them in concentric fashion.

8 Claims, 2 Drawing Figures

EXHAUST MANIFOLD FOR INTERNAL COMBUSTION ENGINE

This invention relates to exhaust manifolds for use with multi-cylinder internal combustion engines, and is particularly directed to a construction which employs a plurality of concentric exhaust reaction chambers which cooperate with shielded exhaust inlet pipes to maintain the exhaust gases at a high temperature for a relatively long period of time in order that oxidation of HC and CO may occur to a great extent before the exhaust gases leave the exhaust manifold. The exhaust inlet pipes convey hot exhaust gases from grouped exhaust ports of the engine directly into the innermost reaction chamber. The second reaction chamber encircles the first, and the third reaction chamber encircles the second. The exhaust inlet pipes are themselves encircled by two concentric tubes, and the spaces between them communicate with the second and third exhaust reaction chambers. In this way oxidation of HC and CO within the exhaust manifold minimizes the quantity of these pollutants discharged into the atmosphere.

This invention will be described in connection with a four-cylinder in-line engine having exhaust ports grouped in pairs of two, but it is to be understood that this is by way of illustration and not of limitation.

Other and more detailed objects and advantages will appear hereinafter.

In the drawings

Figure 1:
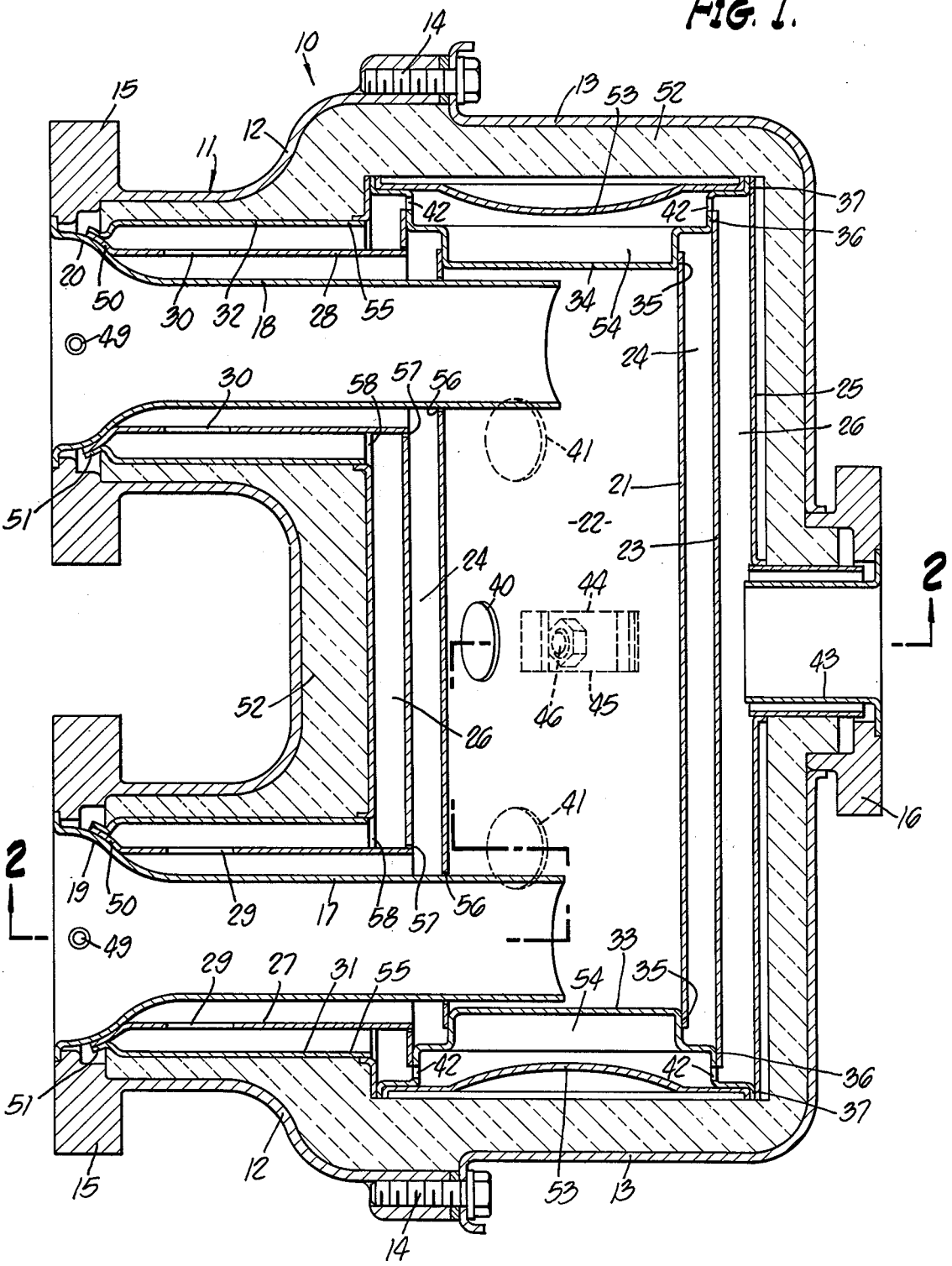
FIG. 1 is a sectional elevation taken substantially on the lines 1—1 as shown in FIG. 2, and showing a preferred embodiment of this invention.
Figure 2:
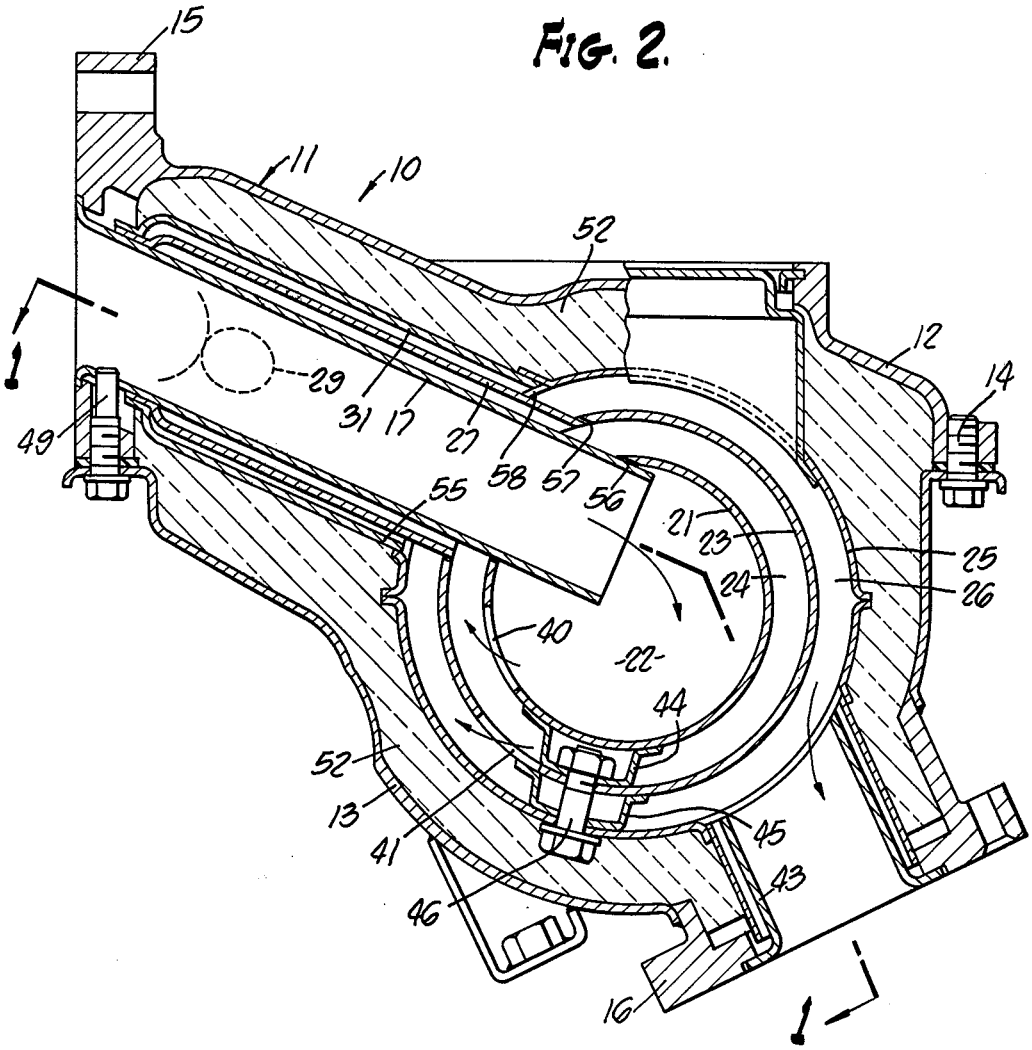
FIG. 2 is a sectional view taken substantially on the lines 2—2 as shown in FIG. 1.

Referring to the drawings, the exhaust manifold generally designated 10 includes an external housing 11 having an upper half 12 and a lower half 13 secured together by threaded fasteners 14. Flanges 15 are provided on the upper half 12 of the housing 11 for connection to the engine. A flange 16 is provided on the lower half 13 of the housing 11 for connection to a tailpipe and silencer, not shown.

Parallel exhaust inlet pipes 17 and 18 are flared as shown at 19 and 20, respectively, in order to receive exhaust gases from engine exhaust ports grouped in pairs, not shown. The exhaust inlet pipes 17 and 18 discharge into opposite ends of a first cylindrical shell 21 forming a first reaction chamber 22. The discharge end of the each exhaust inlet pipe opens tangentially at a position offset from the axis of the first reaction chamber 22. A second cylindrical shell 23 encircles the first cylindrical shell 21 and defines a second reaction chamber 24 which is annular in shape. A third cylindrical shell 25 encircles the second cylindrical shell 23 and forms a third reaction chamber 26 which is also annular in shape. The shells 21, 23 and 25 are concentric. The exhaust gas passing through the each reaction chamber is made to produce a swirl along the inner wall of the chamber.

A first tube 27 encircles the exhaust inlet pipe 17 and, similarly, a first tube 28 encircles the exhaust inlet pipe 18. A port 29 in the tube 27 establishes communication between the annular space inside the tube 27 and the annular space inside the second tube 31. Similarly, the port 30 in the first tube 28 establishes communication between the annular space inside the tube 28 and the annular space inside the second tube 32.

End members 33 and 34 are duplicates, and each is provided with concentric shoulders 35, 36 and 37 for receiving an end portion of the concentric shells 21, 23 and 25, respectively. The engagement between the shells and the end members permits relative axial movement of the ends of the shells under thermal expansion forces. The end members 33 and 34 serve to close the ends of the first, second and third reaction chambers 22, 24 and 26, respectively. A heat insulating plate 53 is attached to the outer end of each end member 33 and 34 to form a heat insulating space 54 therebetween.

A central port 40 in the shell 21 permits exhaust gases to flow from the first reaction chamber 22 into the second reaction chamber 24. Similarly, laterally space ports 41 in the second shell 23 permits exhaust gases to pass from the second reaction chamber 24 into the third reaction chamber 26. Exhaust gases in the second reaction chamber 24 may flow through the space between the exhaust inlet pipes 17, 18 and the encircling tubes 27, 28, respectively, then pass through the ports 29, 30 into the space within the second tubes 31, 32. Port 42 in the end members 33 and 34 permit the exhaust gases to flow into and out of the heat insulating space 54. A discharge pipe 43 within the flange 16 conveys exhaust gases out of the exhaust manifold 10.

From this description it will be understood that exhaust gases from the engine exhaust ports pass into the flared ends 19 and 20 of the exhaust inlet pipes 17 and 18, respectively, and are conveyed to opposite ends of the first reaction chamber 22. The gases then pass through the central port 40 into the second reaction chamber 24 formed between the shells 21 and 23. Exhaust gases leave the second reaction chamber 24 through the spaced ports 41 in the shell 23 to enter the third reaction chamber 26. It will be observed that the first encircling tubes 27 and 28 are in communication with the second reaction chamber 24 and that the second encircling tubes 31 and 32 are in communication with the third reaction chamber 26. A portion of the flow of exhaust gases passes from the second reaction chamber 24 through the interior of the first tubes 27, 28 and then through ports 29 and 30 into the interior of the second tubes 31 and 32 to return to the third reaction chamber 26. Discharge from the third reaction chamber 26 takes place through the discharge pipe 43.

A spacer 44 is fixed to the first shell 21 and a spacer 45 is fixed to the second shell 23. A bolt 46 extends through aligned apertures in the spacers 44 and 45 and in the shells 23 and 25 to prevent relative axial movement of the shells 21, 23 and 25, as well as to space them in concentric. fashion. When the shells 21, 23 and 25 are assembled by the bolt 46 the openings 56, 57 and 58 in the shells 21, 23 and 25, respectively, align in series. The exhaust inlet pipes 17 and 18 pass through the aligned openings 56, 57 and 58. The spacers 44 and 45 and bolt 46 are positioned substantially midway of the length of the shells 21, 23 and 25.

Locater pins 49 maintain the exhaust inlet pipes 17 and 18 in proper position and orientation. The laterally flared portions 19 and 20 of the exhaust inlet pipes 17 and 18 are engaged in surface contact with correspondingly flared portions 50 of the first encirculing tubes 27 and 28. The second encircling tubes 31 and 32 also have end portions 51 which are fixed to the flared ends 50 of the tubes 27 and 28 and have inner end portions 55 which are welded onto the third cylindrical shell 25.

The external housing 11, shell 25, tubes 31 and 32, and end members 33 and 34 define an enclosing space and this space contains heat-insulating material 52.

The construction of the exhaust manifold 10 is such as to maintain the exhaust gases at a high temperature for a long period of time in order to promote the oxidation of CO and HC and thereby reduce the amount of these pollutants discharged into the atmosphere. Each high temperature passage or chamber is encirculed by another passage or chamber carrying downstream gases, and thus the hot gases in the exhaust inlet pipes 17 and 18 are surrounded by hot gases within the tubes 27 and 28 and by hot gases in the three reaction chambers 22, 24 and 26. Similarly, the hot gases in the second reaction chamber 24 are surrounded by hot gases in the third reaction chamber 26. Because of the construction just described, the temperature of the exhaust gases admitted into the inlet pipes 17 and 18 maintains relatively high as the gases pass through the various chambers within the exhaust manifold 10.

Having fully described our invention, it is to be undertood that we are not to be limited to the details herein set forth but that our invention is of the full scope of the appended claims.

We claim:

1. An exhaust manifold for use with a multicylinder internal combustion engine having exhaust ports, comprising, in combination: an external housing, a plurality of laterally spaced parallel exhaust inlet pipes positioned to receive exhaust gases from the exhaust ports of the engine, first, second and third concentric shells extending at substantially right angles to said exhaust inlet pipes and defining first, second and third reaction chambers, means closing the ends of said chambers, said second shell encircling the first shell and the third shell encircling the second shell, said exhaust inlet pipes discharging into the first reaction chamber within said first shell, said first shell having an opening communicating with the second reaction chamber between said first shell and said second shell, said second shell having openings communicating with the third reaction chamber between the second shell and the third shell, a first tube concentric with and encircling each exhaust inlet pipe, respectively, and communicating with said second reaction chamber, a second tube encircling each said first tube, respectively, and communicating with the third reaction chamber between said second and third shells, port means in each first tube establishing communication between the interior thereof and the interior of the encircling second tube, and a discharge pipe communicating with said third reaction chamber.

2. The combination set forth in claim 1 together with spacers positioned midway of the length of said shells for maintaining them in concentric position and for preventing relative axial movement therebetween.

3. The combination set forth in claim 1 wherein the means closing the ends of the chambers includes a pair of end members each having concentric shoulders for engagement with each of the three concentric shells, said engagement permitting relative axial movement of the ends of the shells under thermal expansion.

4. The combination set forth in claim 3 in which said external housing, third shell, second encircling tubes, and end members cooperate to define an enclosing space, said enclosing space containing heat-insulating material.

5. An exhaust manifold for use with a four-cylinder internal combustion engine having exhaust ports grouped in pairs, comprising, in combination: an external housing, two laterally spaced parallel exhaust inlet pipes each being flared to receive exhaust gases from two adjacent exhaust ports of the engine, three concentric cylindrical shells extending at substantially right angles to said exhaust inlet pipes, said exhaust inlet pipes discharging into the innermost shell, the innnermost shell having an opening equidistant from said two exhaust inlet pipes communicating with a first annular space between the innermost shell and the next larger shell, said next larger shell having spaced openings communicating with a second annular space between the two outer shells, a first tube concentric with and encircling each exhaust inlet pipe, respectively, and communicating with said first annular space, a second tube encircling each said first tube, respectively, and communicating with said second annular space between the outer two shells, port means in each first tube establishing communication between the interior thereof and the interior of the encircling second tube, a discharge pipe communicating with said second annular space, and a pair of end members each having concentric shoulders for engagement with each of the three concentric shells.

6. An exhaust manifold for use with a multi-cylinder internal combustion engine having exhaust ports, comprising, in combination: an external housing, a plurality of laterally spaced exhaust inlet pipes positioned to receive exhaust gases from the exhaust ports of the engine, first, second and third shells defining first, second and third reaction chambers, said second shell encircling the first shell and the third shell encircling the second shell, said exhaust inlet pipes discharging into the first reaction chamber within said first shell, said first shell having opening means communicating with the second reaction chamber between said first shell and said second shell, said second shell having opening means communicating with the third reaction chamber between the second shell and the third shell, a first tube concentric with and encircling each exhaust inlet pipe, respectively, and communicating with said second reaction chamber, a second tube encircling each said first tube, respectively, and communicating with the third reaction chamber between said second and third shells, port means in each first tube establishing communication between the interior thereof and the interior of the encircling second tube, and a discharge pipe communicating with said third reaction chamber.

7. An exhaust manifold for use with a multi-cylinder internal combustion engine having exhaust ports, comprising, in combination: an external housing, a plurality of laterally spaced exhaust inlet pipes positioned to receive exhaust gases from the exhaust ports of the engine and each having a flared portion, respectively, said flared portion in a transverse cross-section having only a part of its periphery flared inner and outer shells defining inner and outer reaction chambers, said outer shell encircling the inner shell, said exhaust inlet pipes discharging into the inner reaction chamber within said inner shell, said inner shell having opening means communicating with the outer reaction chamber between said inner shell and said outer shell, a tube concentric with and encircling each exhaust inlet pipe, respectively, and communicating with said outer reaction chamber, said tube having a flared portion, respectively, said flared portion in a transverse cross-section having only a part of its periphery flared the flared portion of said each tube engaging in surface contact with, and capable of sliding longitudinally on, the non-flared part of said each exhaust inlet pipe, and a discharge pipe communicating with said outer reaction chamber.

8. An exhaust manifold for use with a multi-cylinder internal combustion engine having exhaust ports, comprising, in combination: an external housing, a plurality of laterally spaced exhaust inlet pipes positioned to receive exhaust gases from the exhaust ports of the engine, first, second and third concentric shells extending at substantially right angles to said exhaust inlet pipes and defining first, second and third reaction chambers, spacers positioned midway of the length of said shells for maintaining them in concentric position and for preventing relative axial movement therebetween, fastening means fixing said spacers in unitary connection at said position, means closing the ends of said chambers, said means including a pair of end members each having concentric shoulders for engagement with each of the three concentric shells, said engagement permitting relative axial movement of the ends of the shells under thermal expansion, said second shell encircling the first shell and the third shell encircling the second shell, said exhaust inlet pipes discharging into the first reaction chamber within said first shell, said first shell having opening means communicating with the second reaction chamber between said first shell and said second shell, said second shell having opening means communicating with the third reaction chamber between the second shell and the third shell, and a discharge pipe communicating with said third reaction chamber.

* * * * *

UNITED STATES PATENT AND TRADEMARK OFFICE

CERTIFICATE OF CORRECTION

PATENT NO. : 4,075,836

DATED : February 28, 1978

INVENTOR(S) : Shuichi Yamazaki et al

It is certified that error appears in the above-identified patent and that said Letters Patent are hereby corrected as shown below:

Column 1, line 60, delete "the" before "each"

Column 2, line 16, at end of line change "space" to read --spaced--

Column 2, line 53, delete period after "concentric"

Column 2, line 64, correct spelling of "encircling"

Column 3, line 9, correct spelling of "encircled"

Claim 7, line 56, after "flared" insert a comma

Claim 7, line 67, after "flared" first occurrence, insert a comma

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*